United States Patent [19]

Foster

[11] Patent Number: 4,533,301

[45] Date of Patent: Aug. 6, 1985

[54] PUMP

[76] Inventor: Leslie W. Foster, 2154 Sheridan Hills Rd., Wayzata, Minn. 55391

[21] Appl. No.: 650,998

[22] Filed: Sep. 17, 1984

Related U.S. Application Data

[63] Continuation of Ser. No. 484,473, Apr. 13, 1983, abandoned.

[51] Int. Cl.[3] ..... F04B 43/00; F01B 31/10

[52] U.S. Cl. ..... 417/437; 92/31; 92/130 R

[58] Field of Search ..... 92/31, 130, 170; 417/413, 437, 439; 74/56

[56] References Cited

U.S. PATENT DOCUMENTS

| | | | |
|---|---|---|---|
| 608,361 | 8/1898 | Craig | 92/31 |
| 2,711,137 | 6/1955 | Moller | 92/170 |
| 2,819,678 | 1/1958 | Nordell | 417/571 |
| 3,090,313 | 5/1963 | Bodzich | 92/130 |
| 3,134,125 | 5/1964 | Kaiser | 417/413 |
| 3,136,255 | 6/1964 | Von Plato | 92/131 |
| 3,292,554 | 12/1966 | Hesslor | 417/269 |
| 3,811,798 | 5/1974 | Bickford | 417/269 |
| 4,105,368 | 8/1978 | Waters | 74/56 |
| 4,231,721 | 11/1980 | Hauk | 417/413 |

FOREIGN PATENT DOCUMENTS

| | | | |
|---|---|---|---|
| 557228 | 5/1958 | Canada | 92/31 |
| 206701 | 12/1982 | Japan | 417/437 |
| 431237 | 7/1935 | United Kingdom | 74/56 |
| 1235309 | 10/1968 | United Kingdom | 417/439 |
| 1300581 | 12/1972 | United Kingdom | 417/437 |

*Primary Examiner*—William L. Freeh

*Attorney, Agent, or Firm*—John L. Schmitt

[57] ABSTRACT

A pump particularly adapted to produce a pressurized fluid flow has an upper drive section attached to and separated from a lower pumping section by a diaphragm. The diaphragm maintains the integrity of each section to prevent contamination of the fluid, for example. In a housing of the drive section is a rotary drive shaft having an end formed with a camming surface. The drive shaft camming surface engages a camming surface formed on an end of a reciprocating member slideably carried in the housing on a spring. A lower end of the reciprocating member extends through the diaphragm and has a piston positioned in a piston chamber of a cylinder of the pumping section. As the drive shaft rotates, the engaging camming surfaces with the spring reciprocate the reciprocating member. Fluid flow into and from the piston chamber is selectively regulated by valving devices. During operation any fluid bypassing the piston caused, for example, when pump pressure is excessive, may collect in an overflow chamber formed in the cylinder. This bypass fluid may be ejected from the pump and returned to a reservoir. A flexing of the diaphragm by the reciprocating member promotes this return.

6 Claims, 8 Drawing Figures

PUMP

This application is a continuation of application U.S. Ser. No. 484,473 filed Apr. 13, 1983 now abandoned.

BACKGROUND OF THE INVENTION

1. Field of the Invention

This invention relates to pressurized fluid pumping devices and more particularly to a pump having a diaphragm which maintains the integrity of a drive section and a pumping section of the pump and camming surfaces in the drive section which produce reciprocation from rotary motion.

2. Prior Art

Reciprocation of a piston in a cylinder to cause fluid movement is well known and has been used for centuries, for example, to pump water from the ground. Such pumps can be manually or mechanically operated.

Where high performance is required, the pump may be connected to a convenient source of rotary power such as an electric motor. U.S. Pat. No. 2,083,009 discloses a pump where rotary movement from such a power source is converted to reciprocating movement by interacting threaded members. U.S. Pat. No. 2,291,601 discloses a further pump where a rotating cylinder is formed with a cam groove which engages a stationary cam to reciprocate the cylinder as it rotates. U.S. Pat. No. 3,447,345 shows a somewhat similar arrangement wherein a rotating tubular liner has a sinusoidal groove. A pair of pins on an inner cylinder interact with this groove causing the inner liner to reciprocate as the tubular liner rotates.

SUMMARY OF THE INVENTION

A pump of this invention includes an upper drive section connecting with a lower pumping section. These sections are spaced apart by a diaphragm so as to maintain the integrity of each section. A housing of the drive section carries a rotary drive shaft formed with a camming surface. This camming surface engages a further camming surface formed on an end of a reciprocating member supported on a spring in the housing. The reciprocating member is provided with slides to maintain the alignment of the reciprocating member.

The pumping section includes a cylinder formed with an overflow chamber which connects with a piston chamber. An opposite end of the reciprocating member extends through the diaphragm into the overflow chamber and has a piston disposed in the piston chamber.

As the drive shaft rotates, the camming surfaces engage to reciprocate the piston with the aid of the spring. Valving devices connecting with the piston chamber allow fluid to be selectively drawn into the chamber and be ejected therefrom under pressure.

The pump of this invention has several advantages over known pumping devices.

First this pump provides a pumping section discrete from its drive section. Such sectional integrity is particularly important when the fluid being pumped must be maintained contamination free, for example, in food processing, pharmaceuticals, and finishing systems. Since the drive section preferably is lubricated, such lubricant must be kept separate if contamination of the fluid is to be prevented and likewise contamination of this lubricant by the fluid is to be prevented.

Second, this pump provides means for readily recovering fluid bypassing the piston which is inherent when pumping pressure is excessive. This bypass fluid may be readily returned to the system contamination free.

A third advantage provided by this pump is that the piston remains properly aligned within the cylinder piston chamber. This alignment is insured in part by a close lubricated fit of an upper end of the reciprocating member with the housing and the slides carried by the reciprocating member which resist rotational movement of the reciprocating member. If the piston becomes misaligned in the piston chamber, wear between such occurs which will cause the pump to fail.

Thus, the pump is highly reliable, yet quite simple having only several moving parts. Additionally, the pump is compact, allowing a user flexibility in selecting where and how to install the pump.

DESCRIPTION OF THE PREFERRED EMBODIMENT

Figure 1:
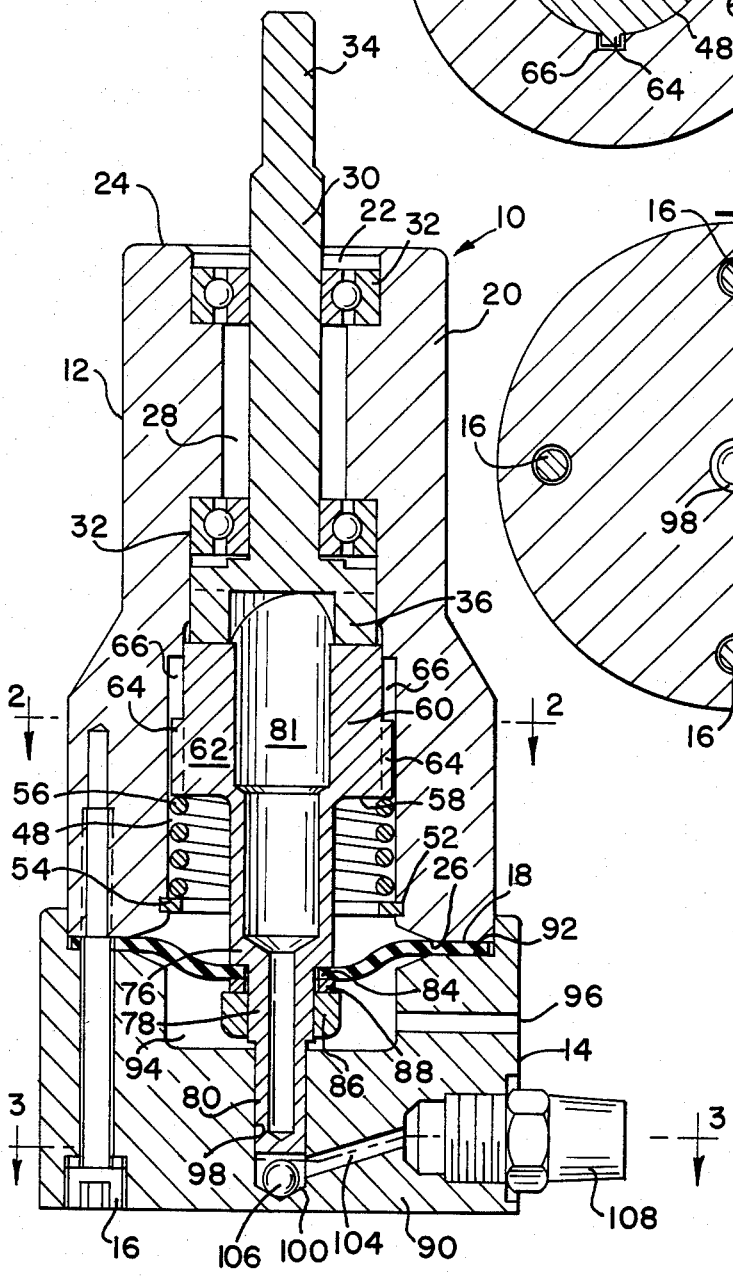
FIG. 1 is an elevational view in cross section of a pump of this invention.
Figure 3:
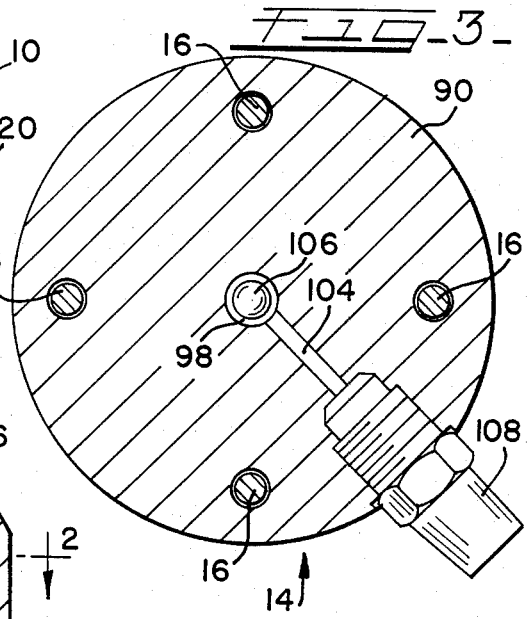
FIG. 3 is a further cross sectional view of the pump as would be seen generally along the line 3—3 in FIG. 1.

A pump of this invention is shown generally in FIG. 1 and designated 10. The pump 10 includes an upper drive section 12 which is connected with a lower pumping section 14 by bolts 16 and spaced apart by a diaphragm 18.

The drive section 12 comprises a housing 20 formed with a central opening 22. The opening 22 extends between a top surface 24 of the housing 20 and a bottom surface 26 which engages the diaphragm 18. The central opening 22 has an upper drive shaft chamber 28 where a drive shaft 30 is journaled in a pair of bearings 32.

Figure 5:
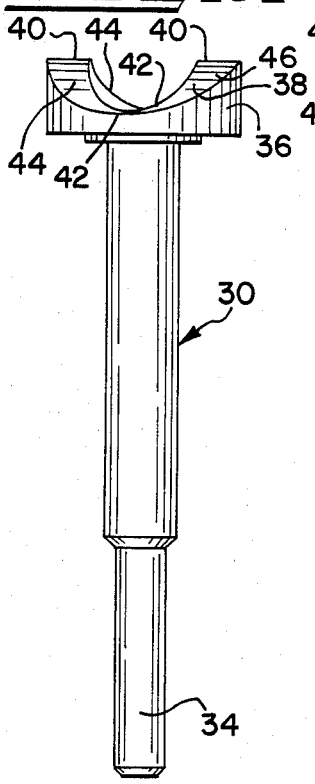
FIG. 5 is an elevation view of a drive shaft of a drive section of the pump.
Figure 6:
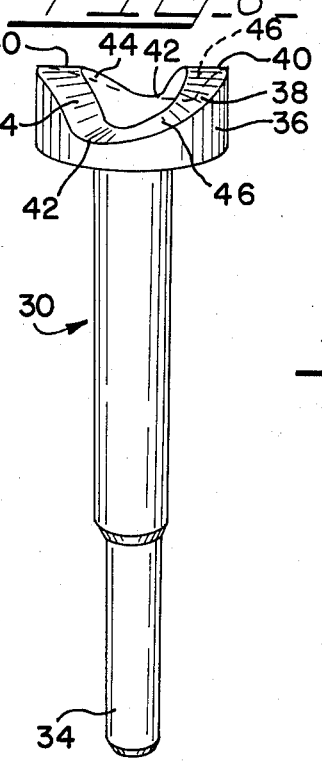
FIG. 6 is a perspective view of the drive shaft of FIG. 5.

The drive shaft 30, shown in detail in FIGS. 5,6, has an outer end 34 which may be connected to a source of rotary power in a known mannner. On an opposite end of the drive shaft 30 is a drive ring 36 having an outward facing camming surface 38. This camming surface 38 has two high points 40 and two low points 42 located 180 degrees apart respectively. Each low point 42 is located at proximately 120/60 degrees between the adjacent high points 40 to form a pair of high profile intake cam segments 44 and a pair of low profile discharge cam segments 46. The slope of each high profile segment 44 is proximately 33 degrees while the slope of the low profile segments 46 is approximately 15 degrees. The amplitude between the high and low points 40, 42 proximates $\frac{1}{4}$ inch.

Connecting with the housing drive shaft chamber 24 is a lower reciprocating member chamber 48. The chamber 48 has a horizontal, circumferential groove 52 which holds a retaining ring 54. The ring 54 in turn supports a lower end of a coil spring 56. An upper end of this spring 56 interacts with a horizontal ledge 58 of an upper part 60 of a reciprocating member 62.

Figure 2:
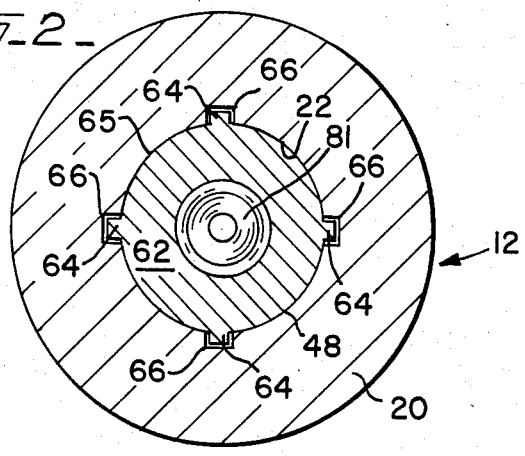
FIG. 2 is a cross sectional view of the pump as would be seen generally along the line 2—2 in FIG. 1.
Figure 7:
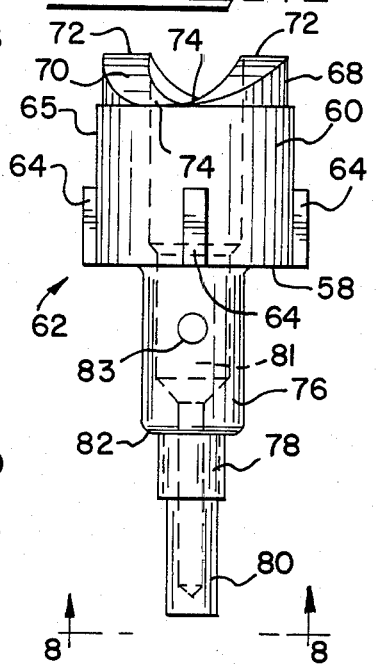
FIG. 7 is an elevation view of a reciprocating member of the pump drive section.
Figure 8:
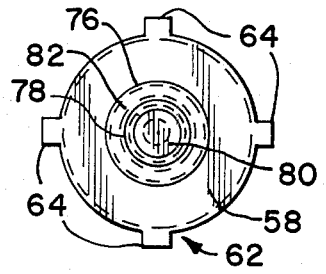
FIG. 8 is a view of the reciprocating member as seen generally along the line 8—8 in FIG. 7.

The reciprocating member 62, shown in detail in FIGS. 7, 8, has four vertical slides 64 located at 90 degree intervals on an outer vertical surface 65 of the reciprocating member upper part 60. The slides 64 fit loosely within four vertical guide grooves 66 formed in the reciprocating member chamber 48, see FIGS. 1, 2, while the outer vertical surface 65 of the reciprocating member upper part 60 fits snugly within the reciprocating member chamber 48.

Connecting with the reciprocating member upper part 60 is a driven ring 68 having an outward facing camming surface 70. This surface 70 is formed to complement the drive shaft camming surface 38 and has a pair of high points 72 and low points 74 located in the same offset positions and have the same amplitude discussed above. Note that a length dimension of this reciprocating member upper part vertical surface 65 is greater than the amplitude of the camming high and low points 72, 74 and thus greater than the stroke of the reciprocating member, which is $\frac{1}{4}$ inch.

Below the reciprocating member upper part 60 is an intermediate part 76 which joins a threaded part 78 which in turn connects with a piston 80. Between the intermediate and threaded parts 76, 78 is a sealing ledge 82 which engages a top surface of the diaphragm 18 about an aperture 84 in the diaphragm 18. To maintain the ledge 82 and the diaphragm 18 in a sealed relationship, a nut 86 compressively engages a washer 88 to force the diaphragm 18 against the reciprocating member sealing ledge 82. The reciprocating member 62 is formed with a hollow space 81 which is connected with the reciprocating member chamber 48 by an opening 83 in the piston intermediate part 76. Note that the reciprocating member 62 can be made in two parts separated by the diaphragm 18. In this case the diaphragm need not have the aperture 84. Further, note that the spring 56 can be located on either side of the diaphragm 18.

Figure 4:
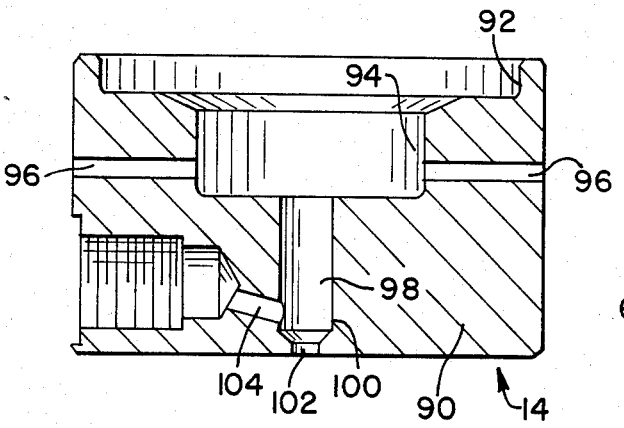
FIG. 4 is an elevation view in cross section of a cylinder of a pumping section of the pump.

As best understood by viewing FIG. 4, the pumping section 14 includes a cylinder 90. The cylinder 90 is formed with an upper circular cutout 92 which holds an outer peripheral portion of the diaphragm 18. Below the upper circular cutout 92 is an overflow chamber 94. The overflow chamber 94 may be connected to an external reservoir (not shown) by a series of overflow ducts 96. Additionally, the overflow chamber 94 connects with a piston chamber 98 in which the piston 80 of the reciprocating member 62 is slideably disposed. Connecting with a lower end 100 of the piston chamber 98 is a inlet passage 102 and a discharge passage 104. Each passage 102, 104 connects with a valving device 106, 108 to control a flow of the fluid into and out of the chamber 98.

During operation the upper outer end 34 of the drive shaft 30 is connected to a convenient source of rotary power to rotate the shaft 30 at proximately 800 rpm. With the reciprocating member 62 in its lower most position, as seen in FIG. 1, the drive shaft camming surface high points 40 are aligned with the reciprocating member camming surface high points 72. As the drive shaft 30 rotates beyond this point, the high profile intake segments of the camming surfaces 38, 70 move into alignment allowing the spring 56 to raise the reciprocating member 62. As the piston 80 moves upward in the piston chamber 98, fluid is drawn through the inlet passage 102 and passes the inlet valve 106. The outlet valve 108 inhibits such a flow. Upon a 60 degree revolution of the drive shaft 30, reciprocating member 62 is in its uppermost position. In this position the drive camming surface high points 40 are aligned with the driven camming surface low points 74.

As the drive shaft 30 rotates further, the low profile discharge cam segments of the camming surfaces 38, 70 move into alignment causing a downward movement of the reciprocating member 62. Fluid in the piston chamber 98 is forced through the outlet passage 104 and outlet valve 108. The inlet valve 106 inhibits such a flow. Upon a 120 degree revolution of the drive shaft 30 the reciprocating member 62 has returned to its lowermost position. Operating at 800 rpm, the pump 10 can deliver between 10 oz. to $\frac{1}{2}$ gal. of liquid per minute at a pressure of proximately 2500 psi.

Note that because of the low profile of the segments of the camming surfaces 38, 70 and the length of these segments, the velocity of the piston 62 during its down stroke is slow and substantially constant. Radial or side forces on the reciprocating member 62 are thus kept to a minimum and remain balanced since the reciprocating member 62 is being acted upon equally on each side of its longitudinal axis by both of the 180 degree spaced low profile discharge segments 46. The camming surfaces 38, 70 could be provided with additional high and low points.

Of particular importance is that the reciprocating member upper part vertical sidewall surface 65 remains concentrically aligned within the reciprocating member chamber 48 which in turn insures that the piston 80 remains concentrically aligned within the piston chamber 98. With such alignment movement of the piston 80 within the piston chamber 98 is substantially linear and wear between such is minimal. This desired alignment is achieved first insuring that the rotational forces imparted by the drive shaft 30 to the reciprocating member 62 are balanced about the longitudinal axis of the reciprocating member 62. Additionally the slides 64 within the guide grooves 66 promote this alignment. Further, this alignment is enhanced by the length of the reciprocating member upper part outer surface 65 being greater than the piston stroke insuring a continuous snug fit with the reciprocating member chamber 48 during pump operation. Lastly, this alignment is advanced by the use of lubricant between the engaging surfaces of the drive shaft 30, reciprocating 62 and the housing 20 in that such lubricant reduces wear therebetween. The reciprocating member hollow space 81 and opening 83 allow the lubricant to circulate within the housing chambers 28, 48.

Because of the pressurized flow produced by the pump 10, a certain small amount of fluid bypasses the piston 80 and flows in the overflow chamber 94. Note that the piston 80 can be formed with its own pressure relief device to allow for an automatic fluid bypass if the pump 10 becomes overloaded. In this case fluid would flow into the overflow chamber 94 in greater quantities. Fluid bypassing the piston 80 may be returned to a source of the fluid by gravity flow through the ducts 96. This return flow may be further enhanced by the diaphragm 18 which flexes as the reciprocating member 62 reciprocates since ambient pressure on each side of the diaphragm is substantially the same. Such returned fluid remains contamination free since the diaphragm 18 maintains the integrity of the pumping section 14 separate and apart from the drive section 12. Likewise, the diaphragm 18 prevents the fluid from contaminating the lubricant in the housing chambers 28, 48.

While only one embodiment of the present invention has been shown and described, it should be understood that the invention is not limited thereto except by the scope of the claims. Various modifications and changes can be made without departing from the scope and spirit of the invention as the same will be understood by those skilled in the art.

I claim:

1. A pump particularly adapted to produce a reliable highly pressurized liquid flow, said pump comprising:

an upper housing, a lower cylinder connected to said housing, a diaphragm interfacing between said housing and said cylinder to form a seal therebetween, a drive shaft journaled in bearing means carried in a drive shaft chamber of said housing, said drive shaft having an end extending from said housing for connection with a source of rotary power and an opposite end formed with a camming surface, a reciprocating member having an upper part slideably disposed in a lubricated reciprocating member chamber connecting with said drive shaft chamber in said housing and supported on a spring carried in said pump with an outer surface of said member upper part fitting snugly in said chamber, said reciprocating member having a camming surface engaging with said drive shaft camming surface to produce a force continually aligned with a longitudinal axis of said member to move said reciprocating member in a first direction in alignment with said axis and compress said spring and free said reciprocating member to allow said spring to move said reciprocating member in a second opposite direction, said fit between said member upper part and said chamber having a length greater than said cam induced movement of said member, said member having a lower end extending beyond said diaphragm and including a piston positioned in a piston chamber in said cylinder with a diameter of said member upper part being greater than a diameter of said piston, and a set of slides on said member upper part with said slides fitting within grooves in said member chamber to inhibit rotation of said member, inlet and outlet valving devices connecting with said piston chamber to allow a flow of said liquid into and from said chamber, and an overflow chamber in said cylinder and connecting with said piston chamber to receive liquid bypassing said piston with said overflow chamber connectable to a source of said liquid to provide for a return to said source, wherein during operation of said pump, rotation of said drive shaft at about 800 rpm. reciprocates said reciprocating member to produce a liquid flow from said pump at pressures proximately 2500 psi., said fit between said member upper part and said member chamber and said alignment of said moving force promoting lineal alignment between said piston and said piston chamber to minimize wear between said piston and said piston chamber as said piston reciprocates therein.

2. A pump as defined by claim 1 and further characterized by, a retaining ring carried on a circumferential groove formed in said housing reciprocating member chamber, said spring carried on said retaining ring with said spring engaging said reciprocating member upper part.

3. A pump as defined by claim 1 and further characterized by, said diaphragm formed with an aperture with said reciprocating member disposed in said aperture with a sealed fit.

4. A pump as defined by claim 1 and further characterized by, said camming surface having opposing high points and low points to transmit forces equally to sides of said reciprocating member, said camming low points being offset between said camming high points formed low profile discharge cam segments and high profile intake cam segments.

5. A pump as defined by claim 4 and further characterized by, said camming surface low points located proximately at 120 degrees from one of said high point and at 60 degrees from said other high point.

6. A pump for producing a high pressure liquid flow in a reliable manner, said pump comprising:

a drive section including a housing, a pumping section connecting with said drive section and including a cylinder portion, a drive shaft journaled in a drive shaft chamber of said drive section housing, said shaft having one end extending from said housing to connect with an external power source and an opposite end formed with a camming surface, a reciprocating member having an upper part slideably disposed with a snug lubricated fit in a reciprocating member chamber in said drive section housing, said member upper part having a set of guides positioned in grooves formed in said member chamber to inhibit member rotation and having a camming surface to engage said drive shaft camming surface to periodically produce a force continuously aligned with a longitudinal axis of said member and member chamber to move said member in a first direction to interact said member with a spring to produce a further force in a second opposite direction with said fit between said member upper part and said member chamber having a length greater than a length of said member movement, a piston connected to said reciprocating member upper part to move therewith, said piston disposed with a snug fit in a piston chamber in said pumping section cylinder with said piston and piston chamber having a longitudinal axis aligned with said member and member chamber axis and with a diameter of said fit of said member upper part and member chamber being greater than a diameter of said fit of said piston and piston chamber, and inlet and outlet valving devices connecting with said piston chamber to allow a selective flow of said liquid to and from said piston chamber, said pump further characterized by, diaphragm means interfacing between said housing and said cylinder to form an overflow chamber between said disphragm means and said piston chamber to receive liquid bypassing said piston and inhibit contact between said liquid and lubrication in said housing, wherein during operation of said pump said forces may reciprocate said member to produce said liquid flow at pressures proximating 2500 psi. with said fit between said member upper part and said member chamber and said alignment of said moving force with said axis of said member and member chamber promoting alignment of said piston with said piston chamber to minimize wear therebetween and thereby inhibit liquid bypassing said piston.

* * * * *